United States Patent [19]

Estes

[11] Patent Number: 4,720,762

[45] Date of Patent: Jan. 19, 1988

[54] CURRENT DRIVE CIRCUIT

[75] Inventor: Bay Estes, Palatine, Ill.

[73] Assignee: Motorola, Inc., Schaumburg, Ill.

[21] Appl. No.: 947,337

[22] Filed: Dec. 29, 1986

[51] Int. Cl.[4] ..... H01H 47/00; H01H 9/00

[52] U.S. Cl. ..... 361/154

[58] Field of Search ..... 361/152, 154

[56] References Cited

U.S. PATENT DOCUMENTS

| | | | |
|---|---|---|---|
| 3,227,889 | 1/1966 | Paynter | 363/43 |
| 4,314,305 | 2/1982 | Williams et al. | 361/154 |
| 4,326,234 | 4/1982 | Shuey | 361/154 |
| 4,399,483 | 8/1983 | Phelan | 361/154 |
| 4,453,652 | 6/1984 | Merkel et al. | 222/504 |
| 4,473,862 | 9/1984 | Hill | 361/155 |
| 4,599,674 | 7/1986 | Ishikawa et al. | 361/154 |

*Primary Examiner*—L. T. Hix
*Assistant Examiner*—David Porterfield
*Attorney, Agent, or Firm*—Robert J. Crawford

[57] ABSTRACT

Disclosed is an arrangement for controlling the current in a solenoid. A microcomputer is used to control three states of a 3-state output device (high impedance, high and low) which are designed to correspond to three current modes of the solenoid: no current, full current and reduced current. The 3-state output device produces a signal which is used to control a solenoid drive circuit. The drive circuit includes first means for generating a first drive signal in response to the 3-state signal being in the high impedance state or the low state, and second means for generating a second drive signal in response to the 3-state signal being in the high impedance state or the high state. The circuit further includes third means for coupling the first and second drive signals to the solenoid such that the current in the solenoid is controlled according to the states of the 3-state signal.

17 Claims, 4 Drawing Figures

CURRENT DRIVE CIRCUIT

FIELD OF THE INVENTION

The present invention relates generally to current drive circuits, and, more particularly, to digital control of current in an electrical device, such as a solenoid.

DESCRIPTION OF THE PRIOR ART

Control circuits for actuating solenoids are well known. Typically, a relatively high "pull-in" current is initially provided to close the solenoid contacts. Once the contacts have been closed, the pull-in current is reduced to what is referred to as a "hold" current. This current efficient control technique is sometimes referred to as a "current reduction feature" for a solenoid drive circuit.

Previously known solenoid drive circuits have failed to implement the current reduction feature in an effective manner. One somewhat popular circuit is illustrative. The circuit includes a monostable multivibrator along with over two dozen active and discrete components to accomplish the current reduction feature for a solenoid. After a control signal actuates the circuit, the monostable multivibrator generates a pulsed output signal which determines the duration of the initial pull-in current. The remaining components handle logic and current drive functions for limiting the current passing through the solenoid coil. Due to the excessive number of components, the cost and the circuit board real estate such a circuit requires is relatively expensive and, in some instances, not tolerable.

In addition to the cost of such previously known circuits being a burden, such known circuits have failed to efficiently interface to the digital domain.

Accordingly, a circuit is needed which not only offers a reduction in cost and circuit board real estate over those known in the art, but one that is also well suited for a digital environment.

OBJECTS AND SUMMARY OF THE PRESENT INVENTION

It is a general object of the present invention to provide a method and apparatus for controlling current in an electrical device which overcomes the above mentioned shortcomings.

It is a more specific object of the present invention to provide a method and apparatus for controlling current in an electrical device which uses less circuitry than those presently known.

It is a more specific object of the present invention to provide a method and apparatus for controlling current in an electrical device which is well suited for digital control.

The invention may briefly be described in terms of a preferred embodiment involving microcomputer control of a circuit for controlling the amount of current through a solenoid. The microcomputer includes an output port which produces a 3-state signal. The three states produced by the 3-state signal are the high impedance state, the high state and the low state. The three state signal controls a circuit which includes first means for generating a first drive signal in response to the 3-state signal being in the high impedance state or the low state, and second means for generating a second drive signal in response to the 3-state signal being in the high impedance state or the high state. The circuit further includes third means for coupling the first and second drive signals to the solenoid such that the current in the solenoid is controlled according to the states of the 3-state signal.

The microcomputer may be used for both switching the states of the 3-state signal and for timing how long the states should exist. For example, the microcomputer may initially cause the circuit coupled to the solenoid to sustain a large amount of current flow through the solenoid for a predetermined period of time. After the predetermined period of time has lapsed, the microcomputer may switch the 3-state signal to another of the states such that the current through the solenoid is decreased, thereby effecting a current reduction feature in a solenoid drive circuit after the solenoid is in the hold position.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in which like reference numerals identify like elements, and wherein:

DETAILED DESCRIPTION OF THE PREFERRED EMBODIMENT

Figure 1:
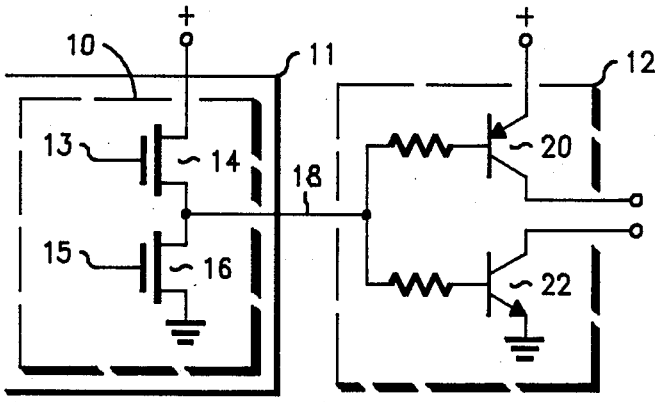
FIG. 1 is a schematic diagram, in accordance with the present invention, of common circuitry which may be used in conjunction with the subsequently described circuits.

Referring now to FIG. 1, an arrangement is shown coupling a microcomputer output 10, from a microcomputer 11, to a dual transistor arrangement 12. The microcomputer output 10 generates first and second drive signals 13 and 15, respectively, which are used to control two FET's 14 and 16. The FET's 14 and 16 are arranged to generate a conventional 3-state output 18. The three states are typically referred to as the high state, the low state and the high impedance state. As will be illustrated below, the three states are used to control an electrical device.

More particularly, the three states are used to control three corresponding states associated with the current passing through the electrical device. One of the three states is used to establish the electrical device in an off state. Another of the three states is used to generate a surge of current (the pull-in current) for a short period of time, while the last state is used to maintain a reduced level of current (the hold current) through the electrical device after the short period of time has lapsed.

In circuit applications where the microcomputer is powered-up with the 3-state output 18 in the high impedance state, it is preferred that the high impedance state be used to establish the electrical device in the off state so as to prevent actuation of the electrical device upon power-up. This preferred power-up control is illustrated and will be discussed with the subsequent figures.

Since many current drive crcuits are designed with the availablility of a microcomputer, the microcomputer may readily be employed to to control the period of time the pull-in current is present. This may be accomplished by programming the microcomputer to control the 3-state output using a conventional timing routine. The microcomputer 11 first sets the 3-state output 18 for the state corresponding to the initial pull-in current, and then begins a predetermined count in a timing loop until the count times out. At this point, the microcomputer sets the 3-state output 18 for the state corresponding to the reduced current.

The 3-state output 18 controls the corresponding states of the electrical device through first and second transistors 20 and 22, respectively, within the transistor arrangement 12. Transistor 20 is the PNP type and transistor 22 is the NPN type transistor. The transistors 20 and 22 act as current drive switches responsive to the 3-state output signal to turn current paths through the transistors on and off. The current paths of transistors 20 and 22 are respectively connected to a positive supply and ground. When the 3-state output 18 is in the high state, the base-emitter junction of the second transistor 22 is forward biased and transistor 22 is on, while the first transistor 20, being reversed biased, is off.

Conversely, when the 3-state output 18 is in the low state, the emitter-base junction of the first transistor 20 is on, while the base-emitter junction of the second transistor 22 is off. When the 3-state output 18 is in the high impedance state, both the first transistor 20 and the second transistor 22 are on. As discussed with FIGS. 2 and 3 below, this switch-like control of the transistors 20 and 22 may be used to provide the basic control signals necessary for controlling an electrical device.

Figure 2:
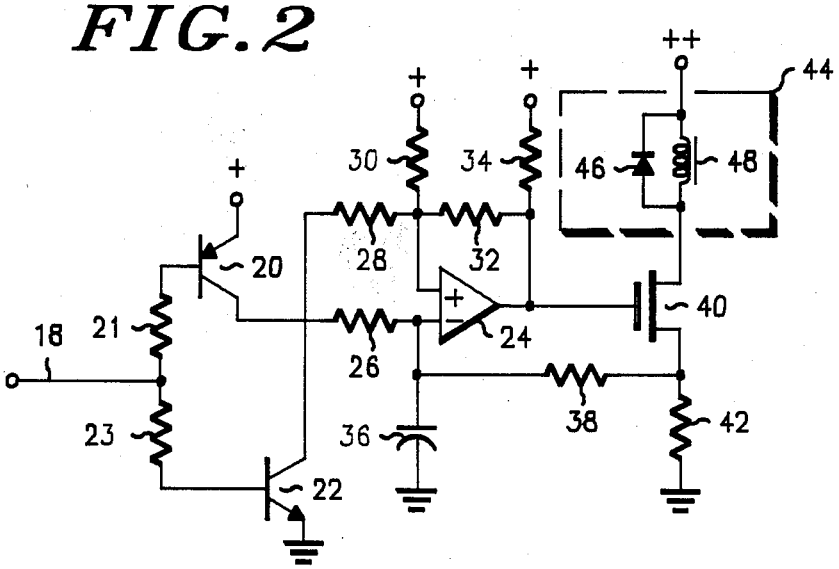
FIG. 2 is a schematic diagram of a current drive circuit according to the present invention.

In FIG. 2, the collectors of transistors 20 and 22 are shown as drive signals for controlling a circuit which may be used to control the current for an electrical device 44, such as a solenoid. The collector of transistor 20 is coupled to the negative input terminal of a comparator 24 through a resistor 26, while the collector of transistor 22 is coupled to the positive input terminal of the comparator 24 through resistor 28.

Also coupled to the positive input terminal of the comparator 24 are resistors 30 and 32. The other side of resistor 30 is connected to the positive supply to provide a high bias to the positive input terminal. The other side of resistor 32 is connected to the output of comparator 24 to provide hysteresis for the comparator during a particular mode of circuit operation. The particular mode of operation is referred to as the "oscillating mode" and will be subsequently discussed.

In addition to resistor 26, a capacitor 36 and a resistor 38 are connected to the negative input terminal of the comparator 24. The other side of the capacitor 36 is connected to ground and is used in conjunction with the oscillating mode of circuit operation. The other side of resistor 38 is connected to the source of a field effect transistor (FET) 40 and is used to provide feedback during the oscillating mode of operation. Also connected to the source of the FET 40 is a resistor 42 which is used as a current sensing resistor.

Connected to the drain of the FET 40 is the electrical device 44, and more particularly, a solenoid coil 48 in parallel with a coil shunting diode 46. When the FET 40 is on, current through the coil 48 is essentially limited by the resistor 42 and the impedance of the coil itself. When the FET is off, essentially no current flows through the coil. When the FET is in the oscillating mode, discussed below, current flows alternately between the FET and the coil shunting diode 46.

The 3-state output 18 is used to control three modes of FET 40 operation, two on modes and one off mode. The three modes operate in the manner described below.

When the 3-state output 18 is in the low state, transistor 20 is on and transistor 22 is off. Since transistor 22 is in the off state, the positive input of the comparator 24 will be biased high by resistor 30. Since transistor 20 is on, the negative input of comparator 24 will be biased to a voltage between the supply voltage and ground, according to the selected values of resistors 26, 38 and 42. The output of comparator 24 will, therefore, be high (very near the supply voltage level). This will force the FET 40 to remain in the on state and current will flow through the coil 48.

When the 3-state output 18 is in the high impedance state, both transistors 20 and 22 are on. Using appropriate resistor selection, this will force the positive input of the comparator 24 lower than the negative input of the comparator 24. This follows since resistors 30 and 32 may be chosen to be significantly greater than resistors 38 and 42 such that the voltage divider circuit formed at the negative input terminal of the comparator 24 is greater than the voltage divider formed at the positive input terminal of the comparator 24 by resistors 30 and 28. Accordingly, the FET 40 will be off when the 3-state output 18 is in the high impedance state and there will be essentially no current flowing through the coil 48. As mentioned previously, this is particularly advantageous when a microcomputer controls the output 18 since most microcomputers power-up with outputs in the high impedance state.

When the 3-state output 18 is in the high state, transistor 20 is off and transistor 22 is on. For the purposes of explaining the circuit operation in this condition, assume that the FET 40 is off. Since the FET 40 and transistor 20 are off, any positive voltage at the negative input of comparator 24 will discharge through the resistor 42 path to ground. Although the transistor 22 is on and current is flowing through the resistor 28, the positive input of the comparator 24 will exceed the voltage level of the negative input terminal and the FET will turn on. Once the FET turns on, the capacitor 36 will charge up to indicate the time period that the electrical device has been on. This will eventually force the voltage at the negative input of the comparator 24 higher than the voltage at the positive input (acting as a reference voltage) of the comparator 24. This will turn the FET 40 off and the capacitor 36 will begin to discharge, thereby forcing the output of the comparator 24 to again change its state. Accordingly, as the output of the comparator 24 changes in voltage level, the feedback path, composed of resistor 38, in conjunction with the capacitor 36, by will cause the output of comparator 24 to oscillate at a frequency and duty cycle determined by the selection of values for the capacitor 36 and the resistors 38 and 42.

The oscillation mode forces the FET 40 to turn the current flowing through the coil 48 on and off, effecting a "hold current" for the electrical device 44 having a current reduction ratio equal to the duty cycle of the oscillating frequency discussed above. When the FET changes from on to off, since the current does not change instantaneously through an inductor, the duty cycle during the oscillating mode of circuit operation may be adjusted such that the solenoid does not move out of the hold position. Such a design restriction allows the circuit to properly perform its "hold current" function.

Conventionally, the electrical device 44 (or solenoid) is connected to a voltage source having a much higher potential than the voltage source which supplies the remainder of the circuitry shown. In this configuration, the oscillating mode of circuit operation is particularly advantageous in that it limits the current through the solenoid, thereby significantly extending the life of the solenoid.

The following component values are suggested for implementing the circuit in FIG. 2:

Capacitor 36: 0.0033 microFarads
Resistors 21 and 23: 100 kOhms
Resistors 26, 28 and 38: 10 kOhms
Resistors 30 and 32: 120 kOhms
Resistor 34: 18 kOhms
Resistor 38: 18 kOhms
Resistor 42: (1 Volt)/I*
Where I* is the desired current through the solenoid in the hold position.

Using these values, the duty cycle of the frequency in the oscillation mode is about 50%. Thus, the current through the solenoid is reduced by the same percentage.

Figure 3:
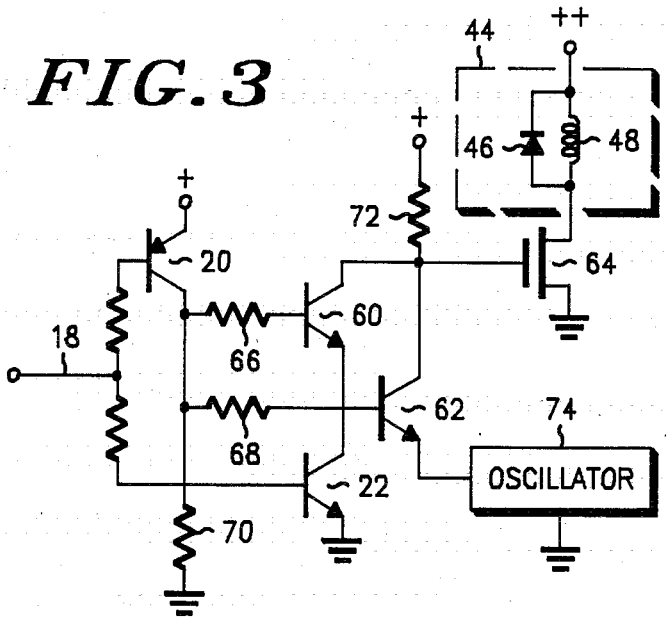
FIG. 3 is an alternate schematic diagram of a current drive circuit according to the present invention.

Referring now to FIG. 3, the transistors 20 and 22 (from FIG. 1) are shown in an alternate circuit configuration for controlling the current in the electrical device 44. The circuit includes two transistors 60 and 62, a FET 64, and four resistors 66, 68, 70 and 72. As in the previously illustrated arrangement, the circuit in FIG. 3 provides three modes for operating the electrical device 44 which correspond to three states of the 3-state output 18.

When the 3-state output 18 is high, transistor 20 is off and transistor 22 is on. Transistor 20 is coupled to the base of transistor 60 through resistor 66 and to the base of transistor 62 through resistor 68. Transistors 60 and 62 are, therefore, off as well. Since transistor 22 is the only transistor which is on, but it is effectively decoupled from the FET 64, resistor 72 provides the FET 64 with the appropriate bias at the gate of the FET and the FET 64 remains on.

When the 3-state output 18 is in the high impedance state, both transistors 20 and 22 are on. This forces transistor 60 to remain on and, since transistor 22 effectively connects the gate of the FET 64 to ground through transistor 60, the FET 64 remains off and no current passes through the coil 48.

When the 3-state output 18 is in the low state, transistor 20 is on and transistor 22 is off. Since transistor 22 is off, transistor 60 remains off and transistor 62 becomes the controlling transistor. The emitter of transistor 62 is connected to an oscillator 74 having a controllable duty cycle. Although a commercial oscillator could be used to implement the oscillator 74, an alternative would be to employ the oscillator the shown in FIG. 2 (when the 3-state output 18 is high), but with resistor 38 connected to the output of the comparator 24 rather than to the FET 40 and the output of the comparator 24 being the oscillator output connected to transistor 62 in FIG. 3. The resistor and capacitor values would be changed appropriately.

With transistor 62 as the controlling resistor, when the output of the oscillator 74 is high the FET 64 is on due to the bias of resistor 72. When the output of the oscillator 74 is low, the FET 64 is off since transistor 62 renders an effective ground at the gate of the FET 64.

The resistors values in FIG. 3 are not critical. However, it is suggested that each be of about the same order of magnitude. For example, each may be about 10 kOhms.

Figure 4:
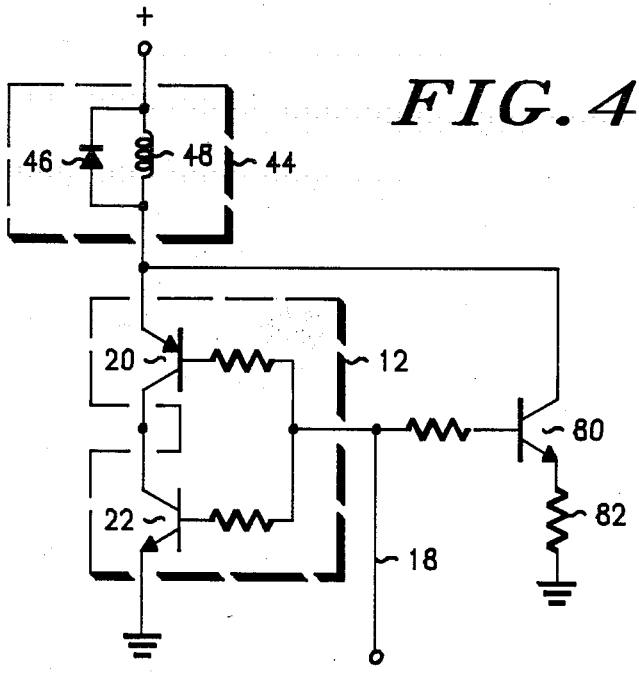
FIG. 4 is another alternate schematic diagram of a current drive circuit according to the present invention.

In FIG. 4, the transistors 20 and 22 (from FIG. 1) are shown in yet another circuit configuration for controlling the current in the electrical device 44. The 3-state output 18 (FIG. 1) controls two current drive arrangements, one comprising transistors 20 and 22, and one comprising a transistor 80, wherein each arrangement is connected to the electrical device 44 for current driving purposes. When the 3-state output is high, the transistor 80 turns on. The current through the coil 48 is then defined by the value of a resistor 82 connected between the emitter of the transistor 80 and ground. Preferably, the value of the resistor 82 is selected such that the transistor 80 drives the electrical device 44 for the hold current, discussed previously.

When the 3-state output is in the high impedance state, both transistors 20 and 22 are on, as well as transistor 80 to provide a pull-in current for the electrical device 44. The collectors of transistors 20 and 22 are interconnected to provide a current path from the electrical device 44 to ground, while the base of transistor 80 is driven by the emmitter-base junction of transistor 20.

The present invention therefore provides a technique for driving current for an electrical device such as a solenoid. The technique provides an initial pull-in current when a surge of current is needed, a hold current to maintain a reduced level of current flow and an off mode. The pull-in and hold currents correspond to and are controlled through a 3-state digital signal. Several circuits are provided for implementing the technique, each employing a minimal number of components and each offering optimal interface for applications requiring digital control, especially one requiring control by a microcomputer.

While the invention has been particularly shown and described with reference to a preferred embodiment, it will be understood by those skilled in the art that various other modifications and changes may be made to the present invention described above without departing from the spirit and scope thereof.

What is claimed is:

1. A circuit for controlling the current in an electrical device, comprising:

a signal source for generating a 3-state signal;

means, responsive to said 3-state signal, for generating a current control signal to control the current in the electrical device at: a pull-in current level in response to a first state of the 3-state signal, a hold current level in response to a second state of the 3-state signal, and an off level in response to a third state of the 3-state signal.

2. A circuit for controlling the current in an electrical device, according to claim 1, wherein the signal source is a computing device in combination with a 3-state transistor arrangement.

3. A circuit for controlling the current in an electrical device, according to claim 2, wherein the computing device is programmed to change the 3-state output from one state to another state after a predetermined time period.

4. A circuit for controlling the current in an electrical device, comprising:

a signal source for generating a 3-state signal having a first state, a second state and a third state;

first means for generating a first drive signal in response to said 3-state signal being in said first state or said second state;

second means for generating a second drive signal in response to said 3-state signal being in said third state or said second state; and third means for receiving said first and second drive signals and, in response thereto, for generating a third drive signal to control the current in the electrical device, wherein the third drive signal includes two current drive levels which correspond to the first and third states and an off state which corresponds to the second state of said 3-state signal.

5. A circuit for controlling the current in an electrical device, according to claim 4, wherein the first means includes a transistor and the second means includes a transistor, and both of said transistors are coupled to the 3-state signal through respective base resistors.

6. A circuit for controlling the current in an electrical device, according to claim 4, wherein the first means includes a PNP transistor which includes its emmitter coupled to a positive voltage source.

7. A circuit for controlling the current in an electrical device, according to claim 4, wherein the second means includes a NPN transistor which includes its emmitter coupled to a negative voltage source.

8. A circuit for controlling the current in an electrical device, according to claim 4, wherein the third means includes an oscillator for generating said alternating on/off state.

9. A circuit for controlling the current in an electrical device, according to claim 8, wherein the third means includes means for comparing a voltage representing the time period that the electrical device has been on with a reference voltage.

10. A circuit for controlling the current in an electrical device, according to claim 4, wherein the first state of the 3-state signal is a high state, the second state is a high impedance state and the third state is a low state.

11. A circuit for controlling the current in an electrical device, comprising:

a signal source for generating a 3-state signal having a first state, a second state and a third state;

first means for driving current through the electrical device in response to said 3-state signal being in said first state, but not said third state;

second means for driving current through the electrical device in response to said 3-state signal being in said first or said second state, but not said third state; and third means, for coupling said first and second drive means, for controlling the current in the electrical device such that the first and second states of the 3-state signal correspond to two current on states, and the third state corresponds to a current off state.

12. A circuit for controlling the current in an electrical device, according to claim 11, wherein the first means includes first and second transistors interconnected via their respective collectors and coupled to the 3-state signal at their respective bases through respective base resistors.

13. A circuit for controlling the current in an electrical device, according to claim 12, wherein the first transistors is a PNP transistor having its emitter coupled through the electrical device to a positive voltage source, and the second transistor is a NPN transistor having its emitter coupled to ground.

14. A circuit for controlling the current in an electrical device, according to claim 12, wherein the second means includes a third transistor having its base coupled to the 3-state signal and to the bases of the first and second interconnected transistors.

15. A circuit for controlling the current in an electrical device, according to claim 11, wherein the first state of the 3-state signal is a high impedance state, the second state is a high state and the third state is a low state.

16. A circuit for controlling the current in a solenoid, comprising:

a microcomputer having at least one output port for generating a 3-state signal having a high state, a low state and a high impedance state;

first means for generating a first signal in response to said 3-state signal being in said high impedance state or said high state;

second means for generating a second signal in response to said 3-state signal being in said high impedance state or said low state; and third means for receiving said first and second signals and, in response to thereto, for generating a third signal to control the current flowing through the solenoid, wherein the third signal includes an oscillating state for reducing the average current through the solenoid, a steady off state for impeding the current through the solenoid, and a steady on state for permitting current to flow through the solenoid, which respectively correspond to the three states of said 3-state signal.

17. A circuit for controlling the current in an electrical device, comprising:

a signal source for generating a 3-state signal having a first state, a second state and a third state;

first means for generating a first drive signal in response to said 3-state signal being in said first state or said second state;

second means for generating a second drive signal in response to said 3-state signal being in said third state or said second state; and third means for receiving said first and second drive signals and, in response thereto, for generating a third drive signal to control the current in the electrical device, wherein the third drive signal includes a steady on state, a steady off state and an alternating on/off state which respectively correspond to the three states of said 3-state signal.

* * * * *